US011412901B2

(12) United States Patent
Librero Martin

(10) Patent No.: US 11,412,901 B2
(45) Date of Patent: Aug. 16, 2022

(54) TOILET WITH SEAT THAT TILTS WHEN LIFTING THE LID

(71) Applicant: Pedro Manuel Librero Martin, Guadalajara (ES)

(72) Inventor: Pedro Manuel Librero Martin, Guadalajara (ES)

( * ) Notice: Subject to any disclaimer, the term of this patent is extended or adjusted under 35 U.S.C. 154(b) by 0 days.

(21) Appl. No.: 17/261,763

(22) PCT Filed: Jul. 25, 2018

(86) PCT No.: PCT/ES2018/070531
§ 371 (c)(1),
(2) Date: Jan. 20, 2021

(87) PCT Pub. No.: WO2020/021130
PCT Pub. Date: Jan. 30, 2020

(65) Prior Publication Data

US 2021/0274985 A1 Sep. 9, 2021

(51) Int. Cl.
*A47K 13/12* (2006.01)
*A47K 13/10* (2006.01)

(52) U.S. Cl.
CPC ..... *A47K 13/12* (2013.01); *A47K 13/10* (2013.01)

(58) Field of Classification Search
CPC ..... A47K 13/10; A47K 13/12
USPC ..... 4/236
See application file for complete search history.

(56) References Cited

U.S. PATENT DOCUMENTS 4,780,914 A 11/1988 Lin
5,341,518 A 8/1994 Uhl
6,052,869 A * 4/2000 Suzuki ..... A47K 13/12 16/341

(Continued)

FOREIGN PATENT DOCUMENTS

GB 2185271 A * 7/1987 ..... A47K 13/10
WO 2011004237 A2 1/2011

(Continued)

OTHER PUBLICATIONS

International Search Report, PCT/ES2018/070531, dated Apr. 1, 2019.

*Primary Examiner* — Christine J Skubinna
(74) *Attorney, Agent, or Firm* — Porzio Bromberg & Newman P.C.

(57) ABSTRACT

The invention relates to a toilet that comprises a bowl, a lid and a seat, wherein the seat and the lid are hingedly connected to one another, comprising means for generating a torque housed in the hinged joint between the lid and the seat of the toilet, wherein said means for generating the torque are such that the torque generated by separating the seat from the lid is greater than the torque generated in the hinge joining the lid and the seat due to the action of gravity, allowing the use of a torsion spring secured by the two ends thereof to separate portions and secured to the lid and to the seat, or a leaf spring that can be twisted, wherein each of the ends of the torsion spring or of the leaf spring is housed and secured in a first bushing and a second bushing, both of which are independent, and wherein the first and second bushings have means for securing to housings formed on the lid or the seat that make up the hinged joint.

5 Claims, 3 Drawing Sheets

(56) References Cited

U.S. PATENT DOCUMENTS

| | | | | |
|---|---|---|---|---|
| 2010/0223718 | A1* | 9/2010 | Andersen | A47K 13/12 4/240 |
| 2018/0084958 | A1 | 3/2018 | Lawhon | |

FOREIGN PATENT DOCUMENTS

| | | | |
|---|---|---|---|
| WO | 2011136669 | A1 | 11/2011 |
| WO | 2017065814 | A1 | 4/2017 |

* cited by examiner

TOILET WITH SEAT THAT TILTS WHEN LIFTING THE LID

OBJECT OF THE INVENTION

The object of the present invention, as the title establishes, is a toilet with a seat that tilts when lifting the lid, toilet being understood as a sanitary element used for collecting and evacuating the excrement and urine from humans towards the sanitation facility and which prevents, by means of a clean water siphon system, the discharge of unpleasant odours from the sewer into inhabited spaces.

The present invention is characterised by the fact that the seat can separate from the lid by means of a force that separates them and that in the case of ceasing to perform said force, the seat automatically tilts towards the position where the lid is, thus, in this way, it is ensured that the seat is always in a position against the lid unless there is an opposing force, and that in the case of men urinating from an upright position, the seat is against the lid, and therefore the hygiene of the seat is maintained.

Therefore, the present invention falls within the field of toilets and particularly within the aspects related to the lid and the seat.

BACKGROUND OF THE INVENTION

Generally, toilets have a seat hingedly connected to the bowl or lower base, and with a lid that is hingedly connected to the seat, being able to hinge or rotate independently from one another, that is, the lid can be lifted without the seat being moved, and the seat can be lowered from the lifted position without the lid being lowered.

The above possibilities entail that when a man urinates in a toilet from an upright position, it may happen that he leaves the seat in the lowered position and therefore residual urine is left on the seat, with the consequent lack of hygiene for the next user.

This lack of hygiene derived from a bad positioning of the seat is what the object of the present invention seeks to solve, but automatically and that even in the event that a user forgets that they must lift the seat when urinating from an upright position, this is not possible, and the seat automatically tilts towards the lid.

Patents WO2017065814 and WO2011004237 are known in the state of the art. Patent WO2017065814 discloses an automatic lifting system of the seat if a pushbutton or button is actuated, which results in complexity of the design, assembly, and costs of the device, leaving the user free to lift the lid or not.

Patent WO2011004237 describes a removable mechanical device to lift a toilet seat, which prevents the user from urinating standing up when the seat of the toilet is in a horizontal position. It is a system the design of which is complex as it aims to be removable.

Therefore, the object of the present invention is to overcome the noted drawbacks of the known systems that allow the seat to be raised when the lid is lifted, particularly the complexity in design, assembly and costs, developing a toilet like the one described below and which is set forth in essence in the first claim.

DESCRIPTION OF THE INVENTION

The object of the present invention is a toilet with a seat able to tilt towards the lid.

The toilet like the one that is the object of the invention comprises a bowl, a lid and a seat, wherein the seat is hingedly connected with respect to the bowl by means of a first hinge, while the lid is attached to the seat by means of a second hinge.

The possibility of automatic tilting of the seat towards the lid when the lid is lifted and the seat is separated from the lid, is achieved by means of means for generating a torque housed in the hinged joint between the lid and the seat of the toilet wherein said means for generating the torque are such that the torque generated by separating the seat from the lid is greater than the torque generated in the hinge joining the lid and the seat due to the action of gravity.

The means for generating said torque can be a spring, which in turn can be a spring that acts by means of torsion or a leaf-type spring that fulfils the same function as the torsion springs.

The means for generating a torque are on the one hand linked to the lid and on the other hand linked to the seat, lacking any action or torsion force when the lid and the seat are attached and progressively acquiring a certain load as the lid and the seat are separated in such a way that said torque is greater than the torque generated by the action of the force of gravity, which causes the seat to be drawn towards the location of the lid.

The means for generating a torque, by each of the ends thereof, are housed and secured in bushings or cylindrical casings independent from one another and wherein said bushings are housed and are secured in housings arranged to that effect on the lid and the seat, having means for securing to do so.

Therefore, the means for generating a torque, thanks to the constructive simplicity thereof, also function as a hinge axis between the lid and the seat and do not require any constructive modification in the elements of the toilet.

Unless indicated otherwise, all of the technical and scientific elements used in this specification have the meaning commonly understood by a person with average skill in the art to which this invention belongs. When this invention is put into practice, methods and materials may be used that are similar or equivalent to the ones described in the specification.

Throughout the description and the claims, the word "comprise" and its variants are not intended to exclude other technical features, additions, components or steps. For those skilled in the art, other objects, advantages and features of the invention will be deduced from both the description and the practical use of the invention.

DESCRIPTION OF THE FIGURES

As a complement to the description provided herein, and for the purpose of helping to make the features of the invention more readily understandable, in accordance with a preferred practical exemplary embodiment thereof, said description is accompanied by a set of drawings which, by way of illustration and not limitation, represent the following.

PREFERRED EMBODIMENT OF THE INVENTION

In light of the figures, a preferred embodiment of the proposed invention is described below.

Figure 1:
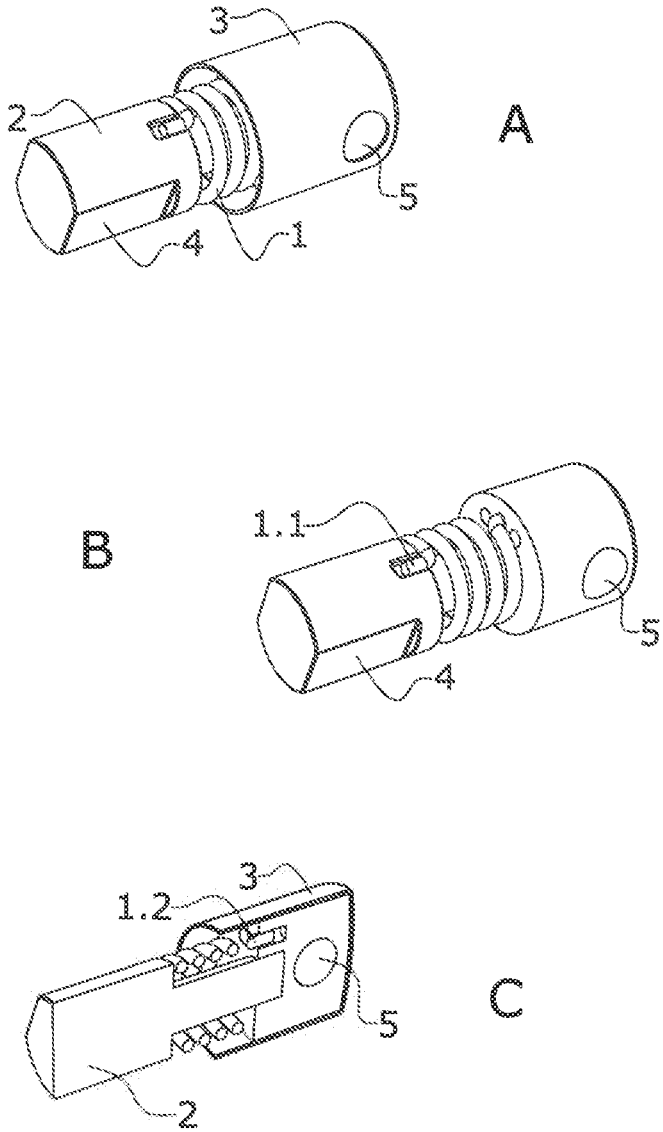
In FIG. 1, points A), B), C) show different illustrations of the actuation of a torsion spring.

FIG. 1 shows a first embodiment of the means for generating a torque, which is by means of a torsion spring (1) housed and secured by each of the ends thereof in bushings or cylindrical housings able to be housed in the hinged joint between the lid and the seat, wherein said bushings are a first bushing (2) and a second bushing (3), both of which are able to rotate independently with respect to each other.

The torsion spring (1) has a first end (1.1) secured to the first bushing (2), and it also has a second end (1.2) secured to the second bushing (3).

Each one of the bushings or cylindrical housings has retention or securing means in housings defined to that effect both on the lid and on the seat respectively, wherein said housings in combination with the bushings make up a hinge capable of generating a torque between the lid and the seat when both are separated and wherein said torque is greater than the torque generated due to the action of gravity.

Thanks to the described configuration, a double functionality is achieved since the means for generating a torque act at the same time as a hinge axis between the lid and the seat, the structural modifications that have to be carried out in the elements manufactured up to now being nil.

In the embodiment shown in FIG. 1, the means for securing the first bushing (2) to a housing provided in the lid or in the seat consist of a notch (4) housed in a recess with the complementary shape, while the means for securing the second bushing (3) to a housing provided in the lid or in the seat consist of a perforation (5).

Figure 2:
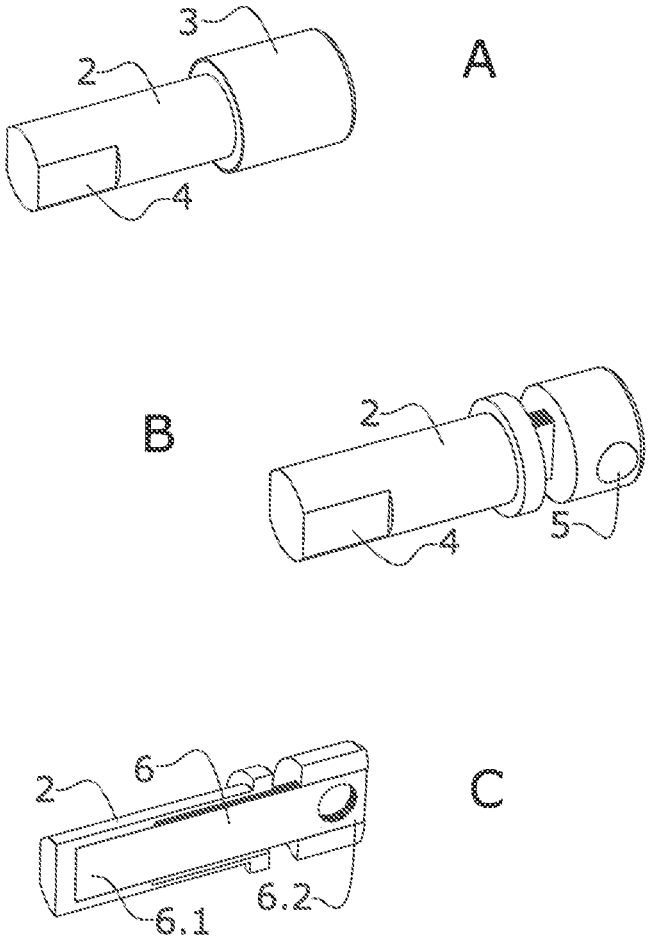
In FIG. 2, points A), B) and C) show the embodiment of the leaf spring.

FIG. 2 shows a second embodiment of the means for generating a torque that is by means of a leaf spring (6), which is a system of tempered steel sheets that fulfils the same function as the torsion springs. Said leaf spring (6) has a first end (6.1) housed in the first bushing (2), while the second end (6.2) of the leaf (6) is housed in the second bushing (3), both bushings rotating independently.

Each of the bushings (2) and (3) also have means for securing to each one of the housings defined in the lid and in the seat.

Figure 3:
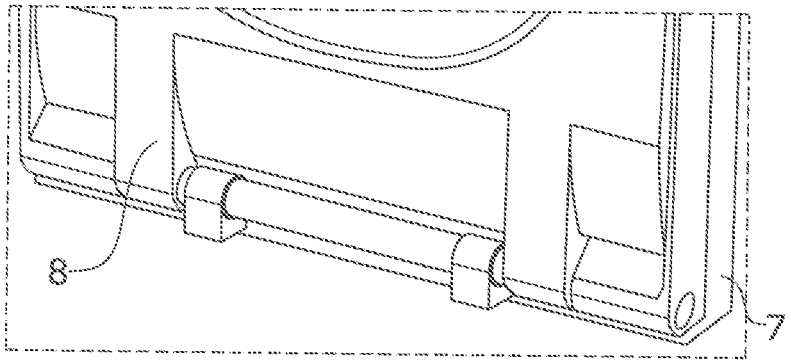
FIG. 3 shows a connection between the lid and the seat of a toilet.

FIG. 3 shows the lid (7) and the seat (8) and how both are linked by means of a hinged joint in which the means for generating a torque are housed, through each one of the bushings thereof.

Figure 4:
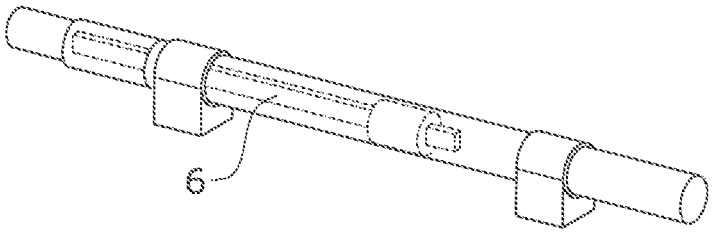
FIG. 4 shows a leaf type spring positioned along the hinge axis.

FIG. 4 shows how the leaf spring (6) runs along the axis joining both elements.

Having thus adequately described the nature of the present invention, as well as how to put it into practice, it must be noted that, within its essential nature, the invention may be carried out according to other embodiments differing in detail from that set out by way of example, which the protection sought would equally cover, provided that the fundamental principle thereof is not altered, changed or modified.

The invention claimed is:

1. A toilet seat, comprising a hinged joint in an axis between a lid and the toilet seat, means for generating a torque housed in the hinged joint, the means for generating torque being a torsion spring or a leaf spring, the means for generating the torque having a first end secured or housed in a first bushing or cylindrical casing within in the hinged joint and a second end secured or housed in a second bushing or cylindrical casing within the hinged joint, the first bushing and the second bushing rotating independently from each other, and the first bushing or cylindrical casing and the second bushing or cylindrical casing having means for securing the respective first bushing or cylindrical casing and the second bushing or cylindrical casing to complimentary housings formed on the lid or the toilet seat wherein said means for generating the torque provides that a torque provides that a torque generated by separating the seat from the lid is greater than a torque generated in the hinged joint joining the lid and the toilet seat due to action of gravity such that the toilet seat tilts when lifting the lid.

2. The toilet with seat according to claim 1, wherein the means for generating the torque is the torsion spring that has the first end secured to the first bushing and the second end secured to the second bushing.

3. The toilet seat according to claim 1, wherein the means for generating the torque is the leaf spring that has the first end housed in the first bushing the second end housed in the second bushing.

4. The toilet seat according to claim 1, wherein the means for securing the first bushing or cylindrical casing to the housing of the lid or the toilet seat is a notch formed on the first bushing and able to be housed in the complementary housing of the lid or the toilet seat.

5. The toilet seat according to claim 1, wherein the means for securing the second bushing or cylindrical casing to the housing of the lid or the toilet seat is a perforation formed in the second bushing.

* * * * *